United States Patent [19]

Roberts et al.

[11] Patent Number: 4,733,766

[45] Date of Patent: Mar. 29, 1988

[54] COIN CHECKING APPARATUS

[75] Inventors: Mark Roberts, Berkshire; Adrian Lewis, Middlesex, both of England

[73] Assignee: Mars, Inc., McLean, Va.

[21] Appl. No.: 805,114

[22] Filed: Dec. 4, 1985

[30] Foreign Application Priority Data

Dec. 5, 1984 [GB] United Kingdom ..... 8430700

[51] Int. Cl.[4] ..... G07D 5/00

[52] U.S. Cl. ..... 194/240; 194/327; 310/328

[58] Field of Search ..... 194/239, 240, 242, 244, 194/317-319, 327; 310/328, 330, 338, 339; 73/DIG. 4

[56] References Cited

U.S. PATENT DOCUMENTS

| | | | |
|---|---|---|---|
| 1,428,632 | 9/1922 | Hendrickson | 194/317 |
| 2,317,351 | 4/1943 | Andalikiewicz et al. . | |
| 3,653,481 | 4/1972 | Boxall et al. . | |
| 3,776,338 | 12/1973 | Johnson | 194/244 |
| 3,801,839 | 4/1974 | Yo | 310/328 X |
| 3,819,962 | 6/1974 | Ivey et al. | 73/DIG. 4 |
| 4,078,187 | 3/1978 | Kanisawa et al. | 310/339 X |
| 4,096,933 | 6/1978 | Massa . | |
| 4,401,909 | 8/1983 | Gorsek | 310/328 X |

FOREIGN PATENT DOCUMENTS

| | | | |
|---|---|---|---|
| 2005038 | 8/1971 | Fed. Rep. of Germany . | |
| 2015491 | 10/1971 | Fed. Rep. of Germany . | |
| 3415273 | 10/1985 | Fed. Rep. of Germany . | |
| 83/00400 | 2/1983 | PCT Int'l Appl. . | |
| 82/02786 | 8/1986 | PCT Int'l Appl. | 194/317 |

*Primary Examiner*—F. J. Bartuska

*Attorney, Agent, or Firm*—Davis Hoxie Faithfull & Hapgood

[57] ABSTRACT

The arrival of a coin in a coin checking apparatus is detected by arranging for the coin to hit a member (16). The vibration caused by the impact causes a piezoelectric element (36,36*a*) to give a transient output signal which is used to switch on electronic circuitry of the coin checking apparatus. The circuitry is normally switched off and thus over a period of time the average power consumption of the coin checking apparatus is low so that it can be satisfactorily run from a battery.

22 Claims, 6 Drawing Figures

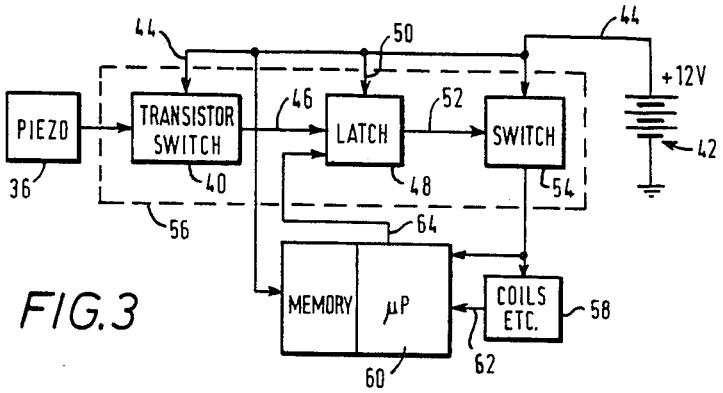
FIG.3
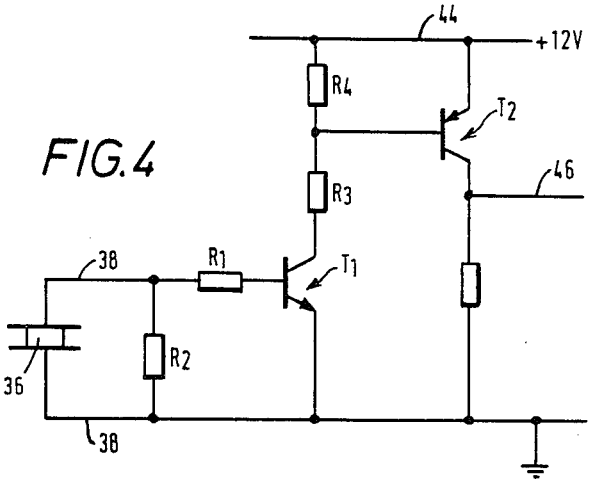
FIG.4
FIG.5
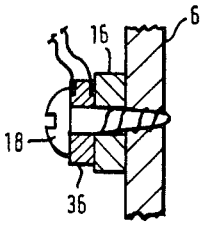
FIG.6
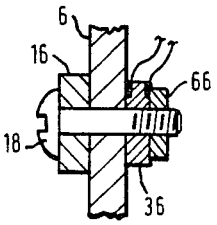

COIN CHECKING APPARATUS

This invention relates to apparatus for checking the validity of coins, which uses electrical power in its coin checking circuitry.

Throughout the specification the term "coin" is intended to mean genuine coins, tokens, counterfeit coins, slugs, washers and any other item which may be used by persons in an attempt to use coin-operated devices.

Apparatus of that general kind is very well known and the power required for its operation is in the great majority of applications derived from the mains electricity supply. In these circumstances, the power consumption of the coin checking apparatus is of little or no importance since it is minimal compared with what is continuously available from the mains supply.

However, there are applications where it is desirable for the coin checking apparatus to be operable independently of a mains power supply. In such applications one or more batteries may be employed to power the coin checking apparatus. The apparatus should be ready for use at all times, and its requirement for battery replacement should be kept to the minimum. It is therefore desirable that the average power consumption of the coin checking apparatus should be reduced as far as possible so as to maximise battery life, thus maximising the continuous period over which the apparatus will be operable before a battery change is needed, and so minimising the frequency of battery changes.

Low average power consumption is also desirable where the primary power source is of low power as for example are solar cells. With such a low powered primary source, rechargeable power storage means such as a capacitor or battery may be employed, the storage means being charged continually and its stored power then being available to meet the relatively high demand for power when the coin checking apparatus operates. If the quiescent power consumption were not low, the necessary amount of stored power may not be available when needed.

The present invention aims to provide apparatus for checking the validity of coins which, in its quiescent state, has extremely low power consumption so that, over a substantial period of time, its average power consumption also will be extremely low.

In general terms, the invention involves leaving the electrical power-consuming aspects of a coin checking apparatus unpowered when the apparatus is not being used and incorporating in the apparatus a piezoelectric element which is so arranged that insertion of any coin into the apparatus will stress the piezoelectric element so that it generates a voltage. This voltage is then used to switch on the power of the apparatus. The piezoelectric element, which senses the arrival of a coin, consumes no power when the apparatus is in its quiescent state, waiting for a coin to be inserted, in contrast to other coin arrival sensing arrangements which have previously been proposed. Thus the invention enables the provision of a coin checking apparatus which consumes power only when it is being used, and in intervening periods ideally consumes none. However, in practice, it is likely that some, though extremely small, power consumption will be required during the quiescent periods.

More specifically, the invention provides apparatus for checking the validity of coins, comprising means defining a coin path, electrically powered coin checking circuitry adapted to check the validity of a coin passing along said coin path, a piezoelectric element arranged so as to be affected by a coin passing along the coin path such as to generate an electrical signal in response to said coin, and switching means operable by said electrical signal to power up the coin checking circuitry whereby to enable the coin checking circuitry to check the validity of said coin.

Preferably, the apparatus comprises a coin impact surface arranged to be hit by a coin passing along the coin path, there being a vibration transmission path from said coin impact surface to the piezoelectric element. Examples will be described in which this is achieved by associating the piezoelectric element very closely with the member which is hit by the coin. However, in the preferred embodiment, the mechanical coupling is achieved simply by having both the piezoelectric element and the surface hit by the coin in communication with a common frame portion of the apparatus. It has been found that even when they are significantly spaced apart on a common frame portion, coin arrival can still be sensed by the piezoelectric element. This facilitates the mechanical design of the apparatus since there is no great constraint on the positioning of the piezoelectric element.

In order that the invention may be more clearly understood, an embodiment thereof will now be described, by way of example, with reference to the accompanying diagrammatic drawings, in which.

Figure 1:
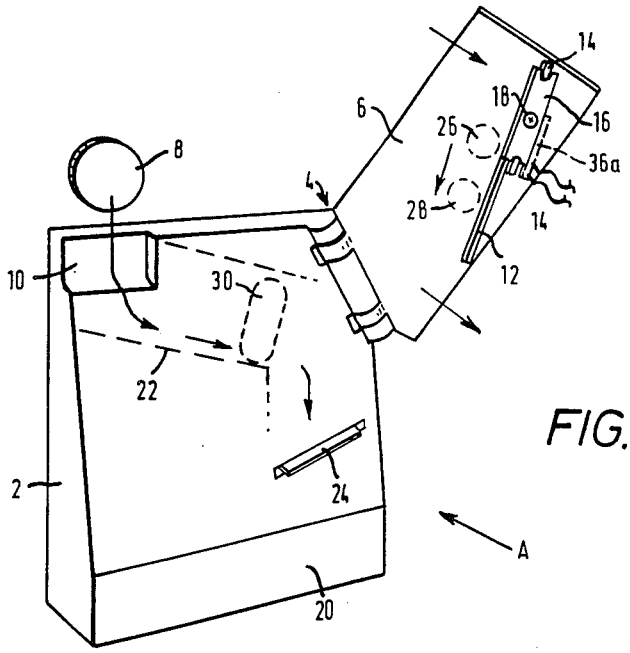
FIG. 1 shows the basic mechanical arrangement of a coin validity checking apparatus the main structure of which is well known but in which the present invention has been applied, the lid of the apparatus being shown in an open position.
Figure 2:
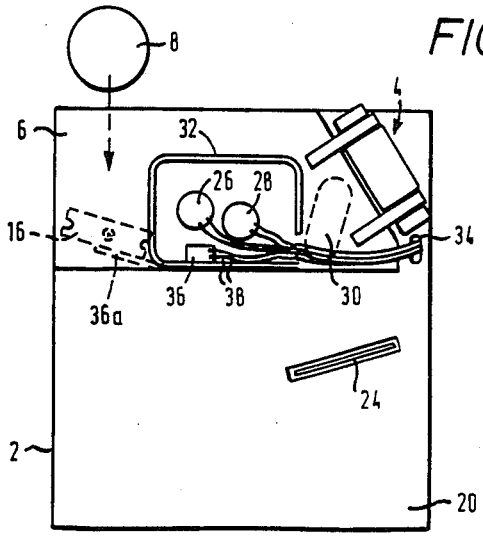
FIG. 2 is an elevation of the apparatus of FIG. 1 taken in the direction of the arrow A, with the lid closed.

FIG. 3 is a schematic circuit diagram of circuitry by means of which the invention is incorporated into the apparatus of FIGS. 1 and 2, FIG. 4 shows a transistor switch circuit which may be used in the circuitry of FIG. 3, and FIGS. 5 and 6 show an alternative form of piezoelectric element to that used in FIGS. 1 and 2, and the way in which it may be mounted in the apparatus.

The apparatus shown in FIGS. 1 and 2 comprises a main frame portion 2, to which is connected by means of a hinge 4 (not shown in full detail) a further and smaller frame portion 6 which in practice is often referred to as a lid and will be so referred to herein. Both frame portions are moulded from a suitable plastics material. Although the lid 6 is shown in the open position for purposes of illustration, it is closed when the apparatus is ready for use. On the inside of the lid, a protruding and sloping coin track 12 is moulded, as are two locating lugs 14. A snubber 16 is provided at its respective ends with recesses which fit round the lugs 14, and the snubber is mounted firmly to the lid 6 by means of both an adhesive (for example a cyanoacrylate adhesive such as Loctite IS422) and a screw 18 which passes through a hole in the snubber 16 and is screwed into a pre-drilled bore in the plastic lid 6. The upper surface of snubber 16 is in line with the upper surface of coin track 12. The snubber 16 is preferably made of a ceramic material as, for example, is disclosed in German Pat. No. 2455106.

The lid 6 is closed for normal operation of the apparatus, and then the snubber 16 and coin track 12 lie against the front face 20 of the main frame portion 2, substantially at the position shown by the broken line 22 in FIG. 1.

Arrows adjacent to both frame portions 2 and 6 show the path of a coin through the apparatus. A coin 8 whose validity is to be checked falls into the coin entry 10 and in a generally downward direction towards the snubber 16. The coin hits the snubber, which absorbs at least most of the coin's energy and causes it to roll without substantial bouncing along the snubber and then along the coin track 12. The coin falls off the end of coin track 12 downwardly towards a gate 24 which is automatically retracted by means of a solenoid if the coin has been found valid and acceptable, so as to direct the coin along an accepted coin path, or is left in position if the coin is not found valid and acceptable in which case the coin hits the gate and rolls off it onto a reject path.

For the purpose of assessing validity of the coin electrically powered inductive sensors are placed along the passageway which lies above the coin track 12. The coin interacts with the fields produced by the sensors. The outputs of the sensors are caused to vary by this interaction, these variations representing measurements of characteristics of the coin, and these measurements are checked against reference values, for example by using a microprocessor, in order for the validity, or otherwise, of the coin to be determined, the actuator gate 24 then being energised only if the coin has been found to be valid.

Two of the inductive sensors, 26 and 28, are located on the front side of the lid 6 and their positions are indicated in broken lines on the inside of the lid 6 in FIG. 1. A third sensor 30 is located on the back of the front plate 20 of the main frame portion 2 and its position also is shown in broken lines in FIG. 1. The electronic circuitry required for coin validation, apart from the sensors 26 and 28 and the leads which run from them, together with the gate actuating solenoid already referred to, is contained in the rear of main frame portion 2, which has a generally box-like configuration. The particulars of the coin validation process do not form part of the present invention but it may, for example, be carried out in accordance with the disclosure in published Application GB A 2093620.

Referring specifically to FIG. 2, the two coils 26 and 28 are secured to the outside of the lid 6 within a rectangular box 32 which is formed by an upstanding wall (i.e. standing outwardly from the plane of the drawing) moulded integrally with the lid 6. A cover (not shown) is fitted over this box to protect the sensors. Four electrical wires which connect the sensors 26 and 28 to the rest of the validating circuitry are led out of the box 32 and through an aperture 34 into the box-like back of the main frame portion 2.

For the purpose of sensing arrival of a coin in the apparatus for checking, a piezoelectric element 36 is provided at the position shown in FIG. 2. Element 36 is in the form of a block of piezoelectric material and is mounted in firm contact with the outside of the lid 6, i.e. on the opposite side of the lid from the snubber 16. In a practical embodiment, the block is approximately 10 mm. long, 5 mm. wide, and 1 mm. thick and is polarised perpendicular to its major surfaces. It is mounted to the lid 6 by means of the cyanoacrylate adhesive previously referred to.

Although the piezoelectric element is not in contact with the snubber 16, and indeed is separated from it not only by the interposition of the lid 6 but also by a substantial spacing apart of the snubber and piezoelectric element along the lid 6, nevertheless it is found that when coin 8 hits the snubber 16 the piezoelectric element 36 generates an output signal which is sufficient for the purpose of turning on the coin checking or validating circuitry. It is believed that this is because there is a vibration transmission path from the impact surface of the snubber to the piezoelectric element 36. The exact nature of the vibrations caused by coin impact, and the exact manner of their transmission, are not well understood, but they reach the piezoelectric element 36 from the impact surface via the snubber 16, its mounting to the lid 6, the lid 6 itself, and the junction of the lid 6 with the piezoelectric element 36. The resulting stress on the element 36 is sufficient to cause it to generate the adequate output signal previously referred to. The transmission path is through continuous solid material owing to the firm contact which is maintained between the snubber 16 and the lid 6, and between the piezoelectric element 36 and the lid 6.

By positioning the piezoelectric element 36 as shown in FIG. 2, it is possible to lead its two output wires 38 along the same path as the wires from the coils 26 and 28 out of the box 32 and round to the back of the main frame portion 2, which is a considerable design advantage.

Piezoelectric blocks suitable for use as the piezoelectric element 36 are commercially available with both faces perpendicular to the direction of polarity precoated with electrical contact material, and with electrical output terminals fitted.

Suitable elements made of piezoelectric ceramic material PZT-5A (a modified lead zirconate titanate ceramic) are available from Vernitron Ltd. of Southampton, England. By making one of the output terminals a wrap-around terminal, both the terminals can be provided on the same face of the block (e.g. the face of the block which is seen in FIG. 2) so as to facilitate the connection of the wires 38 to the block.

Referring now to FIG. 3, there is shown in block form the electrical circuitry, most of which is contained in the rear of the main frame portion 2. In response to a coin hitting the snubber 16, the piezoelectric element 36 produces an output signal which is applied to the input of a very high impedance transistor switch circuit 40 shown in more detail in FIG. 4. The amplitude of the output signal from element 36 varies between coins of different types and varies between coins of the same type. It is typically more than one volt. This is sufficient, when applied across the base and emitter of a first transistor T1 through high-value resistors R1 and R2, to turn that transistor on, thus dropping the base voltage of a second transistor T2 through the effect of two further high-value resistors R3 and R4, so that transistor T2 is switched on and a twelve volt output derived from a battery 42 (FIG. 3) via power supply line 44 appears on the transistor switch output line 46. The very high values of resistors R1 to R4 ensure that the transistor switch 40 has the very high input impedance needed to utilise the output of piezoelectric element 36, and also ensures that the quiescent current drawn from the battery 42 when the switch has not been activated is extremely small, in practice a fraction of a microampere, which is negligible.

The output voltage on line 46 is sufficient to switch a CMOS latching gate 48 from a reset to a set condition in which it stays after the transient output from piezoelectric element 36 has terminated. The latch 48 is also permanently powered from battery 42 and power supply line 44, via line 50 but, again, its power consumption is only a fraction of a microampere and therefore negligible. When set, the latch 48 provides an output on line 52 which operates a semiconductor switch 54 to connect power supply line 44 in circuit with the coin checking circuitry so as to power that circuitry up for the coin checking operation. It will be appreciated that the components shown within the broken-line block 56 constitute together a switching means which connects the supply line 44 in circuit with the coin checking circuitry in response to the output signal given by the piezoelectric element 36.

One section of the coin checking circuitry is indicated at 58 and includes the coils 26, 28 and 30 and their associated circuitry such as oscillators which may be used to drive the coils, or which the coils may form part of. Battery power is also applied by switch 54 to a microprocessor 60 so as to enable it to carry out in known manner comparison tests on the output signals derived from the coils on line 62 so as to determine whether the coin is valid or not. If the coin is determined to be valid, the microprocessor causes the operating solenoid of gate 24 to be energised in known manner, which need not be described, so that the coin is accepted. If the coin is not valid, the gate actuator is not energised and the coin is rejected.

In known manner, the microprocessor also determines the denomination of each accepted coin and records in its memory the total amount of credit due to a user who is inserting coins into the apparatus. The memory of the microprocessor is permanently powered with a few microamperes, which is negligible, to enable retention of necessary information, such as for example the prices of products, when the apparatus is in a vending machine.

The microprocessor is programmed so that if no credit has been recorded within a time delay, for example five seconds, after the piezoelectric element 36 has indicated coin arrival, it resets latch 48 over line 64 so as to remove the output signal from line 52 and open the switch 54, thus powering down the validating circuitry and avoiding waste of power. Thus, if the apparatus is installed in a environment where it is subjected to external vibration sufficient to produce an output from the piezoelectric element 36, the amount of power wasted is minimised.

Further, the microprocessor 60 is programmed such that if it is still recording a credit value after a delay of thirty seconds from acceptance of a coin it resets latch 48 over line 64 and thus powers down the coin validating circuitry, but at the same time maintains its record of the credit. This avoids wasting power by applying the battery power to the validating circuitry for a long period as would otherwise occur if a user left the apparatus with credit still recorded in it.

If the user takes all his credit by goods or services and/or change from the equipment in which the validating apparatus is installed, as is usual at the end of each transaction, then the reduction of the credit to zero also causes the microprocessor to reset latch 48 and thus open switch 54 to bring the apparatus back to its quiescent condition.

The microprocessor may also be programmed to monitor the output voltage of battery 42, and if it falls below an adequate operating level, to render the apparatus inoperative by suppressing generation of accept signals from the coin checking circuitry until an adequate battery voltage is restored, thus avoiding unreliable operation of the apparatus.

The functions of the microprocessor may be performed by other types of circuitry such as custom made LSIs, and the requirements for utilising either a microprocessor or other types of circuitry in coin checking apparatus are well known.

In FIG. 5 a modification is shown in which the piezoelectric element 36 is in the form of an annular washer which is clamped by the head of the screw 18 into direct contact with the snubber 16.

Another modification is shown in FIG. 6 where the piezoelectric element 36 is again in the form of an annular washer, but in this case the washer is placed over the screw on the opposite side of the lid 6 from the snubber 16, and is held in firm contact with the lid 6 by means of a nut 66 which is tightened onto the shank of the screw, thereby also holding the snubber 16 firmly in position.

Referring back to FIG. 1, reference **36*a* shows in broken lines a form and positioning of the piezoelectric element which may be employed instead of the element 36 shown in FIG. 2. Piezoelectric element 36*a* is in the form of a relatively slim bar of piezoelectric material of rectangular cross-section which is adhesively secured directly to the lower surface of the snubber 16**.

We claim:

1. Apparatus with low average power consumption for checking the validity of coins, comprising:

a coin entry through which coins are inserted into the apparatus;

a coin passageway for receiving coins from the coin entry and for directing coins through the apparatus, said coin passageway having a first portion comprising a coin impact surface which is hit by substantially all coins inserted into the apparatus as they begin to travel along the coin passageway;

electrically powered coin checking circuitry adapted to check the validity of coins as they pass along said coin passageway, said circuitry having a quiescent state and a coin validity checking state;

a vibration transmission means for establishing a vibration transmission path;

a coin arrival sensing means comprising a piezoelectric element for generating an electrical signal in response to vibration, said piezoelectric element mounted in a position isolated from the direct impact of coins, both the piezoelectric element and the coin impact surface being firmly mounted to the vibration transmission means so that when a coin hits the coin impact surface, vibrations resulting from the coin hitting the coin impact surface are transmitted through the vibration transmission means to the piezoelectric element which then produces an electrical signal;

and switching means operable by said electrical signal to power up the electrically powered coin checking circuitry from the quiescent state to the coin validity checking state.

2. Apparatus as claimed in claim 1 wherein the transmission path comprises continuous solid material.

3. Apparatus as claimed in claim 1 wherein said piezoelectric element is firmly mounted to a frame portion of the apparatus.

4. Apparatus as claimed in claim 3 wherein said piezoelectric element is bonded to said frame portion.

5. Apparatus as claimed in claim 1 wherein said coin impact surface is on a member firmly mounted to a frame portion of the apparatus.

6. Apparatus as claimed in claim 5 wherein said member is bonded to said frame portion.

7. Apparatus as claimed in claim 5 wherein said member is secured to said frame portion by a screw.

8. Apparatus as claimed in claim 5 wherein said member is secured to said frame portion by bonding and by a screw.

9. Apparatus as claimed in claim 5 wherein said piezoelectric element and said member are both firmly mounted to the same frame portion of the apparatus.

10. Apparatus as claimed in claim 1 wherein said piezoelectric element and said coin impact surface are located on opposite sides of a frame portion of the apparatus.

11. Apparatus as claimed in claim 1 wherein said piezoelectric element and said coin impact surface are substantially spaced apart along a frame portion of the apparatus.

12. Apparatus as claimed in claim 5 wherein said piezoelectric element is mounted in firm direct contact with said member.

13. Apparatus as claimed in claim 12 wherein the piezoelectric element is bonded to the member.

14. Apparatus as claimed in claim 2 wherein said piezoelectric element is in the form of a washer mounted on a screw which secures the element to a frame portion of the apparatus.

15. Apparatus as claimed in claim 14 wherein the screw passes through said frame portion and the washer is held on the opposite side of said frame portion from said coin impact surface by means of a nut on the screw.

16. Apparatus as claimed in claim 14 wherein said screw serves also to secure said coin impact surface to said frame portion.

17. Apparatus as claimed in claim 5 wherein said member is arranged to dissipate the energy of a coin hitting it, so that the coin can proceed on the coin path with little or no bouncing.

18. Apparatus as claimed in any preceding claim wherein said switching means is operable to power up the coin checking circuitry in response to signals generated by the piezoelectric element irrespective of the type of coin causing generation of the signal.

19. Apparatus as claimed in claim 1 further comprising a delay means for powering down the coin checking circuitry if the coin checking circuitry does not indicate that a valid coin has been received within a period after it has been powered up.

20. Apparatus as claimed in claim 1 further comprising a delay means for powering down the coin checking circuitry if the coin checking circuitry indicates receipt of one or more valid coins, and a delay period has elapsed sufficient for receipt of all coins needed for a transaction.

21. Apparatus as claimed in claim 1 further comprising a means for sensing the voltage available from a power supply for the apparatus and disabling the apparatus when the sensed voltage is inadequate for reliable operation.

22. Apparatus as claimed in claim 1 further comprising a rechargeable or replaceable power storage means for powering the coin checking circuitry.

* * * * *